US005950387A

United States Patent [19]

Stahl et al.

[11] Patent Number: 5,950,387

[45] Date of Patent: Sep. 14, 1999

[54] WIND-RESISTANT SHINGLE AND METHOD OF APPLYING

[75] Inventors: Kermit E. Stahl, North Wales; Husnu M. Kalkanoglu, Swarthmore; Robert L. Jenkins, Honey Brook; R. Allan Snyder, Collegeville, all of Pa.

[73] Assignee: CertainTeed Corporation, Valley Forge, Pa.

[21] Appl. No.: 09/075,206

[22] Filed: May 11, 1998

[51] Int. Cl.[6] ..... E04D 1/12

[52] U.S. Cl. ..... 52/559; 52/555; 52/748.1; 52/DIG. 16

[58] Field of Search ..... 52/554, 555, 557, 52/559, 314, 315, DIG. 16, 748.1, 748.11

[56] References Cited

U.S. PATENT DOCUMENTS

| | | | |
|---|---|---|---|
| 1,744,589 | 1/1930 | Striewig | 52/554 |
| 2,113,644 | 4/1938 | Bollaery | 52/557 |
| 3,407,556 | 10/1968 | Leibrook | 52/559 |
| 5,239,802 | 8/1993 | Robinson . | |
| 5,347,785 | 9/1994 | Terrenzio et al. . | |
| 5,660,014 | 8/1997 | Stahl et al. | 52/555 |
| 5,822,943 | 10/1998 | Frankoski et al. . | |

*Primary Examiner*—Michael Safavi
*Attorney, Agent, or Firm*—Paul & Paul

[57] ABSTRACT

A shingle and a method of applying the same to a roof is disclosed, in which the shingles are wind-resistant, opposing being torn from a roof by wind or the like. The shingles each include a pair of vertically spaced-apart lines extending horizontally across the lower ends of butt portions of the shingles, with at least a lower-most line being a line of sealant, and defining between the vertically spaced-apart lines a fastener zone, which fastener zone may have fastening spots therein that, in turn, may define a fastening line. When shingles in accordance with this invention are applied to a roof, the line of adhesive connection between tab portions of shingles in an overlying course are secured to lower ends of butt portions of the shingles of a subjacent course, sufficiently low below the tab portions of shingles, as to preclude any significant engagement by wind or the like that may tend to lift the tab portion off the sealant line. Additionally, the person applying shingles to a roof is directed where to apply the fasteners, so that a greater number of fasteners secure a given shingle to the roof.

16 Claims, 4 Drawing Sheets

WIND-RESISTANT SHINGLE AND METHOD OF APPLYING

BACKGROUND OF THE INVENTION

The present invention is directed to a shingle that is made to be wind-resistant when applied to a roof, as well as to the method of applying the shingle to a roof.

In the art of shingle manufacture, and most particularly in the development of shingles made of a base mat material, generally of organic or synthetic mat, such as fiberglass, the shingles have a coating material, such as a bituminous substance like asphalt or the like applied to both surfaces of the mat, with granules then applied to a top surface of the mat. Such shingles are often of the multi-tab type, having a plurality of tabs at the lower end of the shingle, connected to a butt portion of the shingle at the upper end of the shingle. The tabs are often, but need not be, separated by vertical slots.

In laying up such shingles on a roof, and attaching them to the roof, generally a first course of shingles is applied, with the next course then having tab portions of shingles in that next course covering butt portions of shingles in the previously applied course. This continues, with courses being applied on top of other courses, in each case, with the tab portions of a next-applied course being in overlying relation to a butt portion of a next-previously applied course. Most often, each next course is staggered leftward or rightward relative to the next-previously applied course, so that the slots of adjacent courses are not vertically aligned, although such is not, in all cases, essential.

It has been known in the art to apply adhesive between adjacent courses of shingles, so that the lower end of each tab of a shingle contacts and engages against the lower portion of the butt portion of a shingle in a next-previously applied course, with an adhesive therebetween sealing the lower end of the tab portion of a given shingle to the lower end of the butt portion of a shingle in a next-previously applied course. Often such adhesive is in the form of a band or of separate patches of adhesive, generally horizontally applied, a short distance above the upper ends of the slots of the shingles. Alternatively, or in addition, the adhesive may be applied to the undersurfaces of the lower ends of tab portions, to engage with the lower ends of butt portions of shingles in a next-previously applied course of shingles.

It is also known in the art that it is desirable to nail or otherwise fasten shingles to a roof, by driving nails through the lower ends of butt portions of shingles just above the slots in slotted shingles (or in the same location in unslotted shingles), so that the nails that fasten a given shingle to a roof will also be able to engage the upper ends of butt portions of shingles in a next-previously applied course of shingles.

Such features as are described above are shown, for example, in U.S. Pat. No. 5,239,802, issued Aug. 31, 1993.

Generally, the portion of the back or rear surface of the shingle, which coincides with (or is directly behind) the front surface of the shingle where the band of adhesive exists, is covered with a release-agent-coated tape which prevents adjacent shingles in a stack of shingles from sticking together during shipment. Generally at the time of application of shingles to a roof, the adhesive may or may not be tacky or sticky. In any event, after being subjected to reasonably high temperatures, from exposure to heat from sunlight, such adhesive, even if not originally sticky or tacky, will become so, such that shingles in overlying courses will become adhered to shingles in next-previously applied courses at the locations of the zones or bands of adhesive. Once the lower ends of tab portions of shingles in overlying courses are adhered to lower ends of butt portions of shingles in underlying courses, as a unit, the shingles will resist a tendency of wind to lift tabs and possibly tear the shingles.

In applying shingles to a roof, however, it is often the case that the fasteners that are used in applying shingles are nails that are applied from a nailing gun, often of either the electric or pneumatic types. In applying such shingles by any such automatic means, the roofers doing such applying, tend to apply the nails above the band or zone of adhesive, to avoid contacting the head of the automatic nailer or applicator gun with the adhesive, in order to avoid fouling the applicator gun with adhesive, which might be somewhat soft or sticky at the time that the shingles are being applied to a roof.

Thus, in order to avoid fouling the nailer gun, the roofers tend to apply the nails higher in the butt portion of the shingles, often much too far above the slots. The result often is that the nails that are applied at the lower ends of the butt portions of the shingles are applied too high in the lower ends of the butt portions of the shingles to engage the upper ends of butt portions of shingles in a next-underlying course of shingles, such that shingles result in being secured to a roof with only half as many nailing points per shingle, as should be used to nail shingles to a roof. This can result in a roof having a shorter life than intended and can lead to warranty claims that are not substantiated by reason of shingle manufacture, but only by reason of incorrect installation.

The present invention is directed toward a shingle and a method of applying shingles to a roof, in which guidance is provided to a roofer, as to where the nails or other fasteners should be applied, and wherein adhesive is applied to shingle butt portions in a band that is sufficiently low that the lower ends of tab portions are secured to the lower ends of butt portions of next-subjacent shingles.

Accordingly, it is a primary object of this invention to provide a shingle having a predetermined nailing zone.

It is another object of this invention to provide a shingle having a pair of lines, between which the nailing zone or area is established.

It is a further object of this invention to accomplish the above object, wherein at least the lower line in the pair is comprised of an adhesive band.

It is a further object of this invention to accomplish the above object, in which the adhesive band is just above the upper ends of slots in a shingle.

It is another object of this invention to accomplish the above objects wherein, when shingles are laid up in courses on a roof such that only tab portions of shingles are exposed, fasteners applied in the predetermined fastener area or band will pass through upper ends of the butt portions of shingles of the next-underlying or next-subjacent course.

It is a further object of this invention to provide a novel method of applying shingles to a roof, to resist wind-induced separation of the shingles from one another, and possibly stripping of the same from the roof, by applying shingles of the type described in the objects above, and wherein the fastening of the shingles of the overlying course to the roof is done by applying fasteners through the fastener zones or areas of the overlying course of shingles and through the upper ends of butt portions of shingles of the next-underlying course of shingles.

Further objects of this invention reside in accomplishing the above objects, in which indicia on the shingles define generally horizontal lines of fastener application.

Other objects and advantages of the present invention will readily apparent to those skilled in the art from a reading of the following brief descriptions of the drawing figures, detailed descriptions of the preferred embodiments and the appended claims.

SUMMARY OF INVENTION

A shingle is provided having a predetermined area or band for fastener placement in the lower end of the butt portion of the shingle, between a pair of vertically spaced-apart lines, at least a lower one of which comprises a line of sealant. A method is provided for applying a shingles of the above type to a roof, whereby the fastening of the shingles of the overlying course is done by applying fasteners through the fastener areas of the overlying course of shingles and through the upper ends of butt portions of shingles of a next-underlying course of shingles, in order to resist wind-induced separation of the shingles from one another, and possibly stripping of the same from the roof.

BRIEF DESCRIPTION OF THE DRAWING FIGURES

DETAILED DESCRIPTION OF THE PREFERRED EMBODIMENTS

Figure 1:
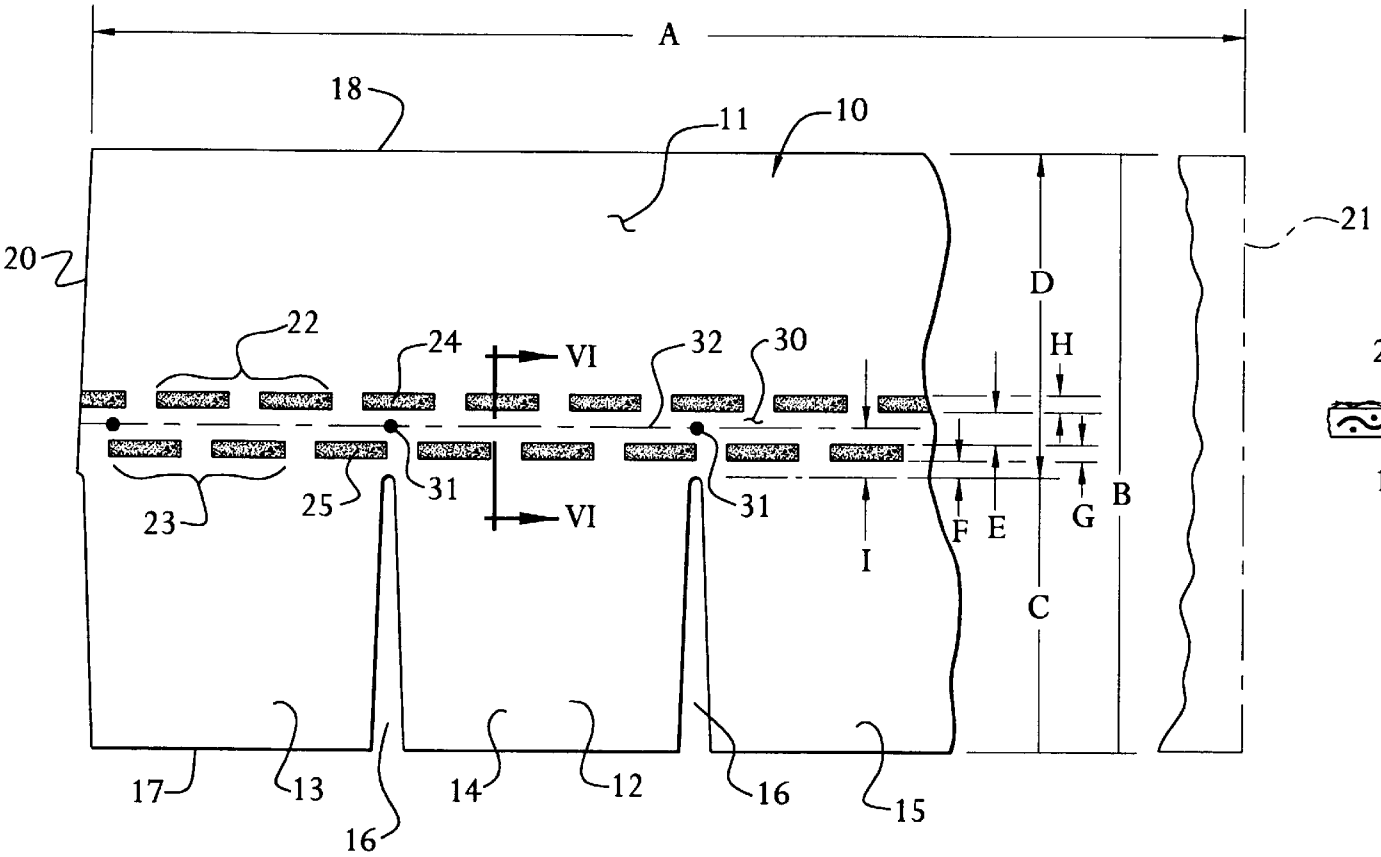
FIG. 1 is a fragmentary top plan view of a shingle in accordance with this invention, with various dimensional relationships indicated, with the shingle being partially broken away for ease of illustration, and wherein indicia on the shingle define a line of faster application.

Referring now to the drawings in detail, reference is first made to FIG. 1, wherein there is illustrated the shingle of this invention, generally designated by the numeral 10, as having an upper, butt portion 11 and a lower, tab portion 12. The tab portion 12 includes a plurality of tabs 13, 14 and 15, separated by generally vertically extending slots 16 extending vertically upwardly from a lower edge 17 of the shingle. The upper edge of the shingle is designated by the numeral 18, and the left and right edges by the numerals 20 and 21 respectively (the latter being in phantom).

Figure 6:
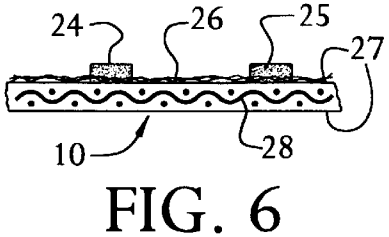
FIG. 6 is an enlarged fragmentary sectional view of a portion of the shingle, indicating the mat, coating, granule and adhesive construction thereof, with the view being taken generally along the line VI—VI of FIG. 1.

The shingle 10 is provided with a pair of generally horizontal, visually distinct, vertically spaced-apart lines 22 and 23 which extend longitudinally of the shingle in the lower end of the butt portion of the shingle. The lines 22 and 23 are comprised of a plurality of spaced-apart patches of adhesive 24, 25, disposed on top of a layer of granules 26 (FIG. 6). The layer of granules 26 is, in turn, shown as applied to an asphalt, bitumen or like coating 27 that is applied and adhered to a base mat 28, preferably of fiber-glass construction, although the same can be of organic material construction, if desired.

The patches 24, taken together, comprise a line of sealant, as do the patches 25.

Vertically located between the lines 22 and 23 is a fastener zone or area 30, which is longitudinally-extending, and which serves to direct a predetermined location for fastener placement, such as nail placement, in applying shingles to a roof.

In the embodiment of FIG. 1, there is shown a plurality of fastener spots 31, disposed above the upper ends of slots 16, to comprise nailing zones or fastener zones.

An imaginary line 32, drawn through the fastener spots or zones 31 is generally horizontal, and is essentially midway between the lines 22, 23. The patches 24 and 25 that comprise the lines 22 and 23 are preferably visually discontinuous, as shown, as is the line 32 defined by the spots 31.

With particular reference to FIG. 1, it will be seen that, in a preferred embodiment, the shingle 10 is shown to have a longitudinal length, as measured in the horizontal direction, of A, which in a particular embodiment could be 36 inches. Such a shingle could have a vertical height B of 18 inches, of which the tab portion C from the bottom edge 17, to the top of the slots 16, is 8 inches in vertical height, leaving the butt portion 11 of the shingle, to have a dimension D in the vertical direction, of 10 inches. A shingle of such dimensions may be constructed in accordance with the teachings of U.S. Pat. No. 5,209,802. The invention is, however, useable on shingles of virtually any dimensions.

In accordance with a shingle as shown in FIG. 1, the vertical spacing between spaced-apart lines 22, 23 of sealant could be as shown by the vertical dimension E, to be 1 1/16 inches, in which the spacing of the line 23 above the upper edge of the slots 16 would preferably be as shown by the dimension F, to be ½ inch. Also, in a preferred embodiment, the height of the sealant lines 23, 22, as shown by the vertical dimensions G and H, respectively, would be ⅜ inch in each case. Also, in the preferred embodiment of FIG. 1, the preferred fastener line 32, through the spots 31, would be at a vertical dimension I of 1 13/32 inches above the upper edges of the slots 16.

Figure 2A:
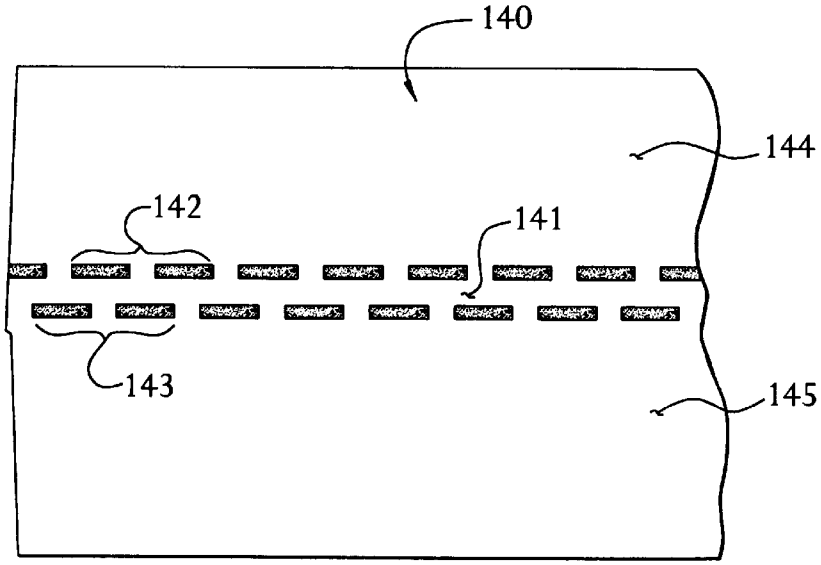
FIG. 2A is a view similar to that of FIG. 2, but wherein the shingle is of the type that does not have vertical slots in its tab portion.
Figure 2:
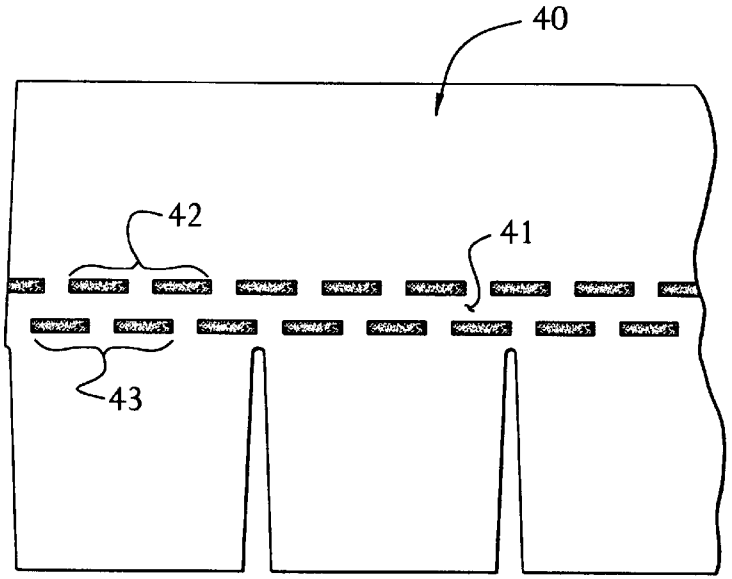
FIG. 2 is a fragmentary view of a shingle similar to that of FIG. 1, but wherein it is the spaced-apart generally horizontal lines that define a fastener zone or area, without specific indicia indicating a line of fastener application.

Referring now to FIG. 2, it will be seen that an alternative embodiment for the shingle of FIG. 1 is shown at 40, but differing from the shingle of FIG. 1 in that there are no fastener spots as shown, it being understood that the fastening zone or nailing zone for the shingle 40 would be at 41, between the sealant lines 42, 43, and that the essential difference between the embodiments of FIGS. 1 and 2 is that in the embodiment of FIG. 2, there are no visually distinct fastener spots to define a specific fastener line in the zone 41.

With reference now to FIG. 2A, it will be seen that the shingle 140 has a nailing zone 141 between sealant lines 142 and 143, like the embodiment of FIG. 2. The shingle 140, however, is not one of the type having vertical slots that separate its tab portion into separate tabs, as such. Rather, the shingle of FIG. 2A has a butt portion 144 and a tab portion 145, with its nailing zone 141 between the sealant lines 142, 143, in precisely the same locations they would be if the shingle 140 had vertical slots defining the tab portion 145 into separate tabs. It will thus be understood that, in describing this invention, the terms "butt portion" and "tab portion" are used to define the upper and lower portions or areas of the shingles, as shown in FIGS. 2 and 2A, for example. As such, the tab portions of the shingles are the portions of the shingles that are exposed, or uncovered, when installed on a roof, as shown for example in FIGS. 4 and 5.

Figure 3:
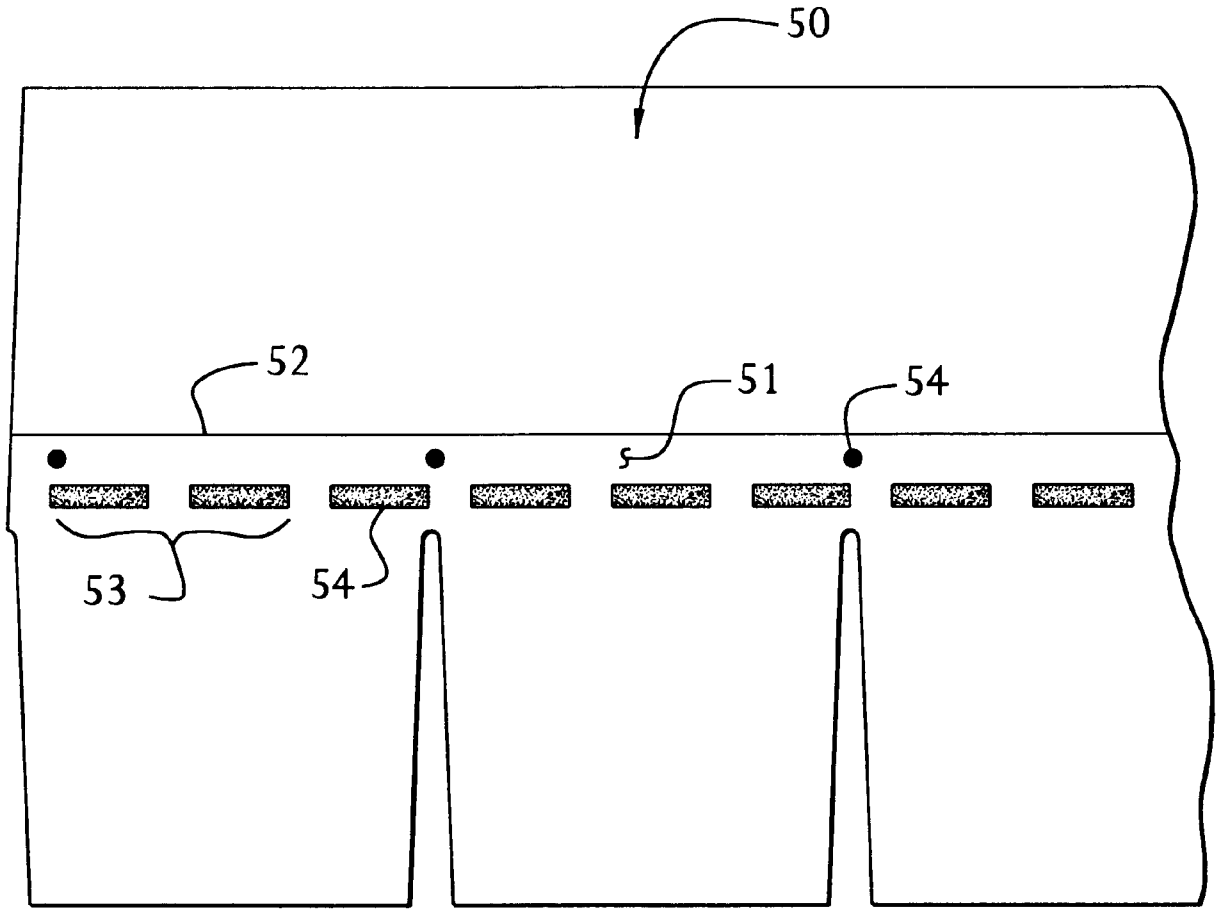
FIG. 3 is an illustration like that of FIG. 2, but wherein the upper of the two spaced-apart generally horizontal lines is not a line of adhesive application, whereas the lower line is a line of adhesive application, and wherein indicia for fastener application is shown in a line, along the lower end of the butt portion of the shingle.

With reference now to the embodiment of FIG. 3, it will be seen that a shingle 50 is shown as comprising a shingle like that of FIG. 1, except that in the fastener zone 51 between the spaced-apart lines 52 and 53, there are a plurality of fastener spots 54 like those 31 in FIG. 1, which define a fastener line therebetween. Also, in the embodiment of FIG. 3 it will be seen that the line 52 is not comprised of a plurality of patches of sealant like the patches 54 of sealant that comprise the line 53. Rather, the line 52 is a visually distinct scribed, printed, or otherwise indicia-comprised line 52, on the top surface of the shingle of FIG. 3 as shown. Of course, in the alternative, the patches 54 of sealant may comprise the line 52, whereas the line 53 would be visually distinct, as by being a scribed, printed, or otherwise indicia-comprised line, etc.

Figure 4:
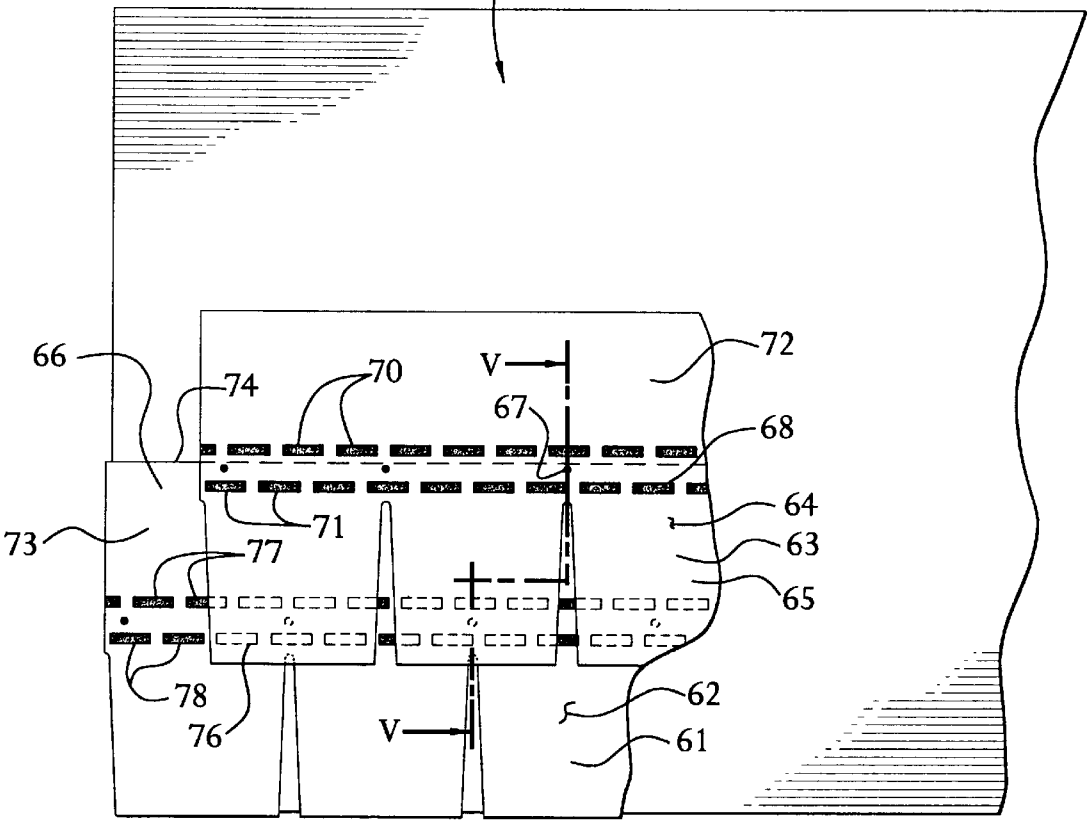
FIG. 4 is a fragmentary illustration of two shingles, in application to a roof, with the relationship of a next-overlying shingle being shown relative to that of a next-underlying shingle, along with zones of adhesive application and nailing zones being clearly illustrated.

With reference now to FIG. 4, it will be seen that a sloped roof 60 is shown, having an underlying or subjacent course 61 of shingles 62 applied thereto, and with a next overlying course 63 of shingles 64 applied thereon, with tab portions 65 of shingles 64 in the course 63 overlying butt portions 66 of shingles 62 in the next-underlying or subjacent course 61, as shown.

It will thus be seen that the shingle 64, when applied to a roof and secured thereto by nails 67 applied in the fastener zone between spaced-apart sealant lines 70, 71 at the lower end of the butt portion 72 of shingle 64, nails 67 will engage the upper end of the butt portion 73 of the shingle 64, just below the upper horizontal edge 74 thereof, such that a given shingle 64 is secured to the roof 60 by means of a line of nails 67, each approximately above the upper edges of slots, in addition to the fastening that is provided by nails or other fasteners 76 between sealant lines 77 and 78 of adhesive in the lower ends of butt portions of shingles 62, such that there are two nailing lines or fastener lines securing each shingle 62 to the roof 60, one at the lower end of the butt portion 73 thereof, and one at the upper end of the butt portion 73 thereof.

Figure 5:
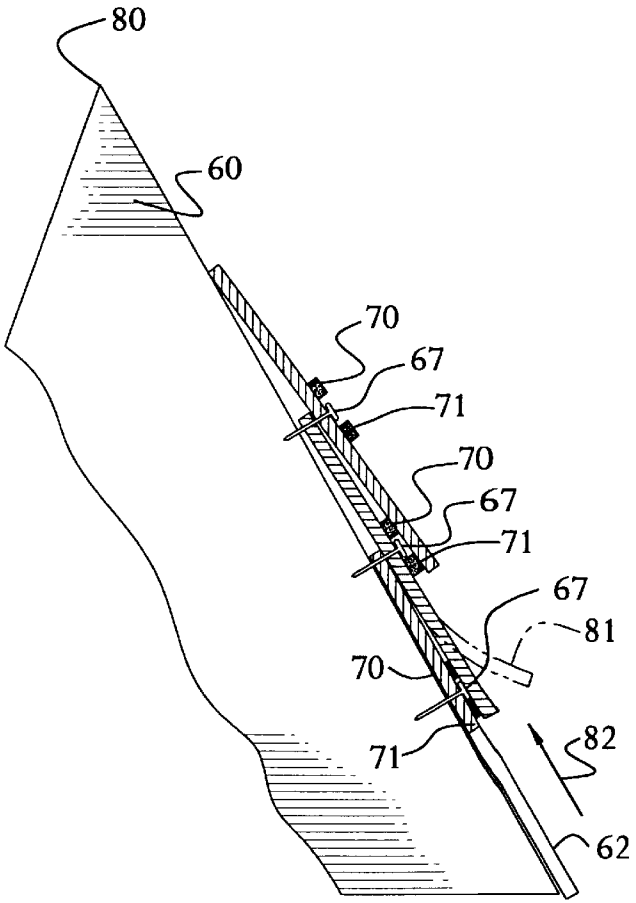
FIG. 5 is a vertical sectional view, taken through the shingles and roof of FIG. 4, generally along the line V—V of FIG. 4, and wherein a tab portion of a shingle in one of the courses is shown partially in phantom as would be the case if the shingle were not resistant to being uplifted by wind.

It will thus be seen that additional courses of shingles can be applied over the shingle 64, in much the same manner as the shingle 64 is applied relative to the shingle 62, as is shown at the right end of FIG. 5, such that overlying courses of shingles will have the lower ends of their tab portions disposed to be sealingly secured to the lower ends of butt portions of next-subjacent shingles in a next-underlying course of shingles, as shown. The roof 60 will then be built up in this manner, until the roof is completely shingled up to the peak 80. It will also be seen that each shingle will have two lines of nails or other fasteners, with one such line at a lower end of the butt portion and one such line at the upper end of the butt portion, securing the shingles to the roof at two distinct vertically spaced-apart locations for each shingle and in each case, along a line thereof.

It will also be seen that the nails 67 or other fasteners will be applied in a predetermined area or zone, between spaced-apart lines 71, 70, with at least the lower one of each line 71, 70, in a pair, preferably comprised of a discontinuous line of adhesive patches, or a full line of adhesive (if desired), to define for the roofing installer, a predetermined nailing zone. Preferably, the upper line 70 of each pair 71, 70, will also be a discontinuous line of adhesive, but, as described above, such could be a drawn line or a scribed line as may be desired.

With the application of heat from normal changes in temperature, the adhesive substance of the adhesive lines will be come soft and tacky so that lower ends of tab portions of shingles overlying such adhesive lines will become secured to lower ends of butt portions of next-subjacent shingles, as shown and described.

At the lower right end of FIG. 5, there is shown in phantom, an upturned tab 81 of shingle, to demonstrate how wind blowing in the direction shown by the arrow 82 might engage beneath a tab portion of a shingle and lift the same upwardly, to possibly lead to tearing or breakage, if adhesive were not applied to lower ends of butt portions of next-subjacent shingles, to secure them to lower ends of tab portions of shingles in a next-overlying course, as described above.

In addition to preventing up-lifting of shingle tabs by wind or the like, it is also seen that each shingle can be fastened to a roof by a pair of nailing lines or other fastener lines, as shown.

It will be apparent from the foregoing that the objects of the invention are satisfied in that the roofer or other person applying shingles to a roof is directed by the shingle itself, as to where the nailing of the shingle is to take place, such that shingles are applied to a roof by means of two lines of fastener application, and wherein a line of adhesive is applied below the lower line of fastener application, and above the upper ends of slots, to adhesively secure tab portions of shingles in a overlying course to the lower ends of butt portions of shingles in an underlying course, sufficiently low under the tab portion of the overlying course as to prevent wind from engaging the same and lifting a tab upwardly to form an unfastened flap that might become torn from the shingle and consequently from the roof.

It will be apparent from the foregoing that various modifications may be made in the details of construction, as well as in the use and installation of shingles in accordance with this invention, all within the spirit and scope of the invention as defined in the appended claims.

What is claimed is:

1. A wind-resistant shingle having front and rear surfaces comprising a web coated with a solidified coating material and having a layer of granules on a surface of the coating material, with the shingle having a butt portion and a tab portion, each of which portions extend longitudinally of the shingle; with the butt portion having a lower end and an upper end and with the tab portion having a lower end and an upper end, and with the lower end of the butt portion merging with the upper end of the tab portion; with a pair of generally horizontal, visually distinct, vertically spaced-apart lines extending longitudinally of the front surface of the shingle in the lower end of the butt portion of the shingle, on the layer of granules, adjacent the upper end of the tab portion of the shingle; with at least the lowermost one of the vertically spaced-apart lines comprising a line of sealant; and with said visually distinct vertically spaced-apart lines defining therebetween a generally horizontal, longitudinally-extending fastener area for visually directing a predetermined location for fastener placement in applying shingles to a roof.

2. The shingle of claim 1, wherein both of said pair of vertically spaced-apart lines comprise lines of sealant.

3. The shingle of claim 1, wherein indicia means on the shingle define a generally horizontal longitudinally-extending, visually distinct line of fastener application, located in said fastener area.

4. The shingle of claim 3, wherein said line of fastener application is visually discontinuous.

5. The shingle of claim 4, wherein the shingle is a multi-tab shingle having generally vertically disposed, horizontally spaced-apart slots in the tab portion and wherein said discontinuous line of fastener application comprises fastener location spots above the upper ends of said slots.

6. The shingle of any one of claims 1–5, with said at least one line of sealant being discontinuous.

7. The shingle of any one of claims 1–5, wherein the shingle has an overall height in the vertical direction of essentially 18 inches, with the butt portion having an overall height in the vertical direction of essentially 10 inches and the tab portion having an overall height in the vertical direction of essentially 8 inches and wherein the fastener area has a sealant-free height in the vertical direction within the range of ½ inch to 1 and 1/16 inches.

8. The shingle of any one of claims 1–5, wherein the fastener area is at a vertical height in the butt portion of the shingle to comprise means whereby, when shingles are laid up in courses on a roof, with tab portions of shingles of an overlying course overlying butt portions of shingles of a next-underlying course, leaving only tab portions of shingles exposed, fasteners applied in the fastener area when fastening shingles to a roof will pass through the upper ends of the butt portions of shingles of the next-underlying course.

9. The shingle of claim 8, wherein the shingle has an overall height in the vertical direction of essentially 18 inches, with the butt portion having an overall height in the vertical direction of essentially 10 inches and the tab portion having an overall height in the vertical direction of essentially 8 inches and wherein the fastener area has a sealant-free height in the vertical direction within the range of ½ inch to 1 and 1/16 inches.

10. The shingle of claim 4, wherein the shingle is of the single-tab type, not having slots in its tab portion, and wherein said discontinuous line of fastener application comprises fastener location spots in the lower end of the butt portion of the shingle.

11. A method of applying shingles to a roof to resist wind-induced stripping of shingles from the roof, comprising:

(a) providing an underlying course of shingles, each having a web coated with a solidified coating material and having a layer of granules on a surface of the coating material, with each shingle having:

a butt portion and a tab portion, each of which portions extend longitudinally of the shingle; with the butt portion having a lower end and an upper end and with the tab portion having a lower end and an upper end, and with the lower end of the butt portion merging with the upper end of the tab portion; with a pair of generally horizontal, visually distinct, vertically spaced-apart lines extending longitudinally of the shingle in the lower end of the butt portion of the shingle, on the layer of granules, adjacent the upper end of the tab portion of the shingle; with at least the lowermost one of the vertically spaced-apart lines comprising a line of sealant; and with said vertically spaced-apart lines defining therebetween a generally horizontal, longitudinally-extending fastener area for directing a predetermined location for fastener placement in applying shingles to a roof;

(b) fastening the shingles of the underlying course to the roof by applying fasteners through the fastener areas of the underlying courses of shingles into the roof;

(c) providing an overlying course of shingles, each having a web coated with a solidified coating material and having a layer of granules on a surface of the coating material, with each shingle having:

a butt portion and a tab portion, each of which portions extend longitudinally of the shingle; with the butt portion having a lower end and an upper end and with the tab portion having a lower end and an upper end, and with the lower end of the butt portion merging with the upper end of the tab portion; with a pair of generally horizontal, visually distinct, vertically spaced-apart lines extending longitudinally of the shingle in the lower end of the butt portion of the shingle, on the layer of granules, adjacent the upper end of the tab portion of the shingle; with at least the lowermost one of the vertically spaced-apart lines comprising a line of sealant; and with said vertically spaced-apart lines defining therebetween a generally horizontal, longitudinally-extending fastener area for directing a predetermined location for fastener placement in applying shingles to a roof;

(d) applying shingles in the overlying course to the roof with tab portions of shingles of an overlying course overlying butt portions of shingles of a next-underlying course, leaving tab portions of shingles exposed; and (e) fastening the shingles of the overlying course to the roof by applying fasteners (i) through the fastener areas of the overlying course of shingles; and (ii) through upper ends of butt portions of shingles of the next-underlying course of shingles.

12. The method of claim 11, wherein both of said pair of vertically spaced-apart lines comprise lines of sealant on each shingle.

13. The method of claim 11, wherein indicia on the shingles define generally horizontal, longitudinally-extending, visually distinct lines of fastener application, located in said fastener areas, and where the fasteners are applied through the lines of fastener application.

14. The method of any one of claims 11–13, wherein the lines of fastener application are visually discontinuous.

15. The method of claim 13, wherein the shingles are multi-tabbed shingles having generally vertically disposed, horizontally spaced-apart slots in the tab portions and wherein said discontinuous lines of fastener application comprise fastener location spots above the upper ends of said slots, and wherein the fasteners are applied through the fastener spots.

16. The method of claim 14, wherein the shingles are of the single-tab type, not having slots therein and wherein said discontinuous line of fastener application comprises fastener location spots in the lower ends of butt portion of the shingle, and wherein the fasteners are applied through the fastener spots.

* * * * *